US007866721B2

(12) United States Patent
Hollin

(10) Patent No.: US 7,866,721 B2
(45) Date of Patent: Jan. 11, 2011

(54) OILFIELD ELEVATOR

(75) Inventor: Michael Andrew Hollin, Didsbury (CA)

(73) Assignee: Tesco Corporation, Houston, TX (US)

( * ) Notice: Subject to any disclaimer, the term of this patent is extended or adjusted under 35 U.S.C. 154(b) by 489 days.

(21) Appl. No.: 11/951,210

(22) Filed: Dec. 5, 2007

(65) Prior Publication Data

US 2008/0150305 A1 Jun. 26, 2008

Related U.S. Application Data

(60) Provisional application No. 60/868,684, filed on Dec. 5, 2006.

(51) Int. Cl.
*E21B 19/06* (2006.01)

(52) U.S. Cl. ..... 294/90; 294/102.2

(58) Field of Classification Search ..... 294/90, 294/91, 102.1, 102.2, 106, 116, 119.2
See application file for complete search history.

(56) References Cited

U.S. PATENT DOCUMENTS 1,527,534 A 2/1925 Black
1,599,144 A 9/1926 Paulsen
1,646,981 A 10/1927 Rick
1,670,048 A * 5/1928 Rick ..... 294/90
1,766,556 A 6/1930 Smith
1,782,754 A * 11/1930 Wilcox ..... 294/91
2,065,781 A * 12/1936 Wilson ..... 294/90
2,215,649 A 9/1940 Mullinkx
2,264,775 A * 12/1941 Spang ..... 294/90
2,392,462 A * 1/1946 Coe ..... 294/90
2,722,450 A 11/1955 Nelson
2,957,724 A 10/1960 Bujold
3,358,341 A 12/1967 Burstall
3,884,519 A 5/1975 McFadden
4,396,216 A 8/1983 Hamilton
5,340,182 A 8/1994 Busink et al.
7,434,614 B2 * 10/2008 Nelson et al. ..... 166/77.52

* cited by examiner

*Primary Examiner*—Dean J Kramer
(74) *Attorney, Agent, or Firm*—Bracewell & Giulieni LLP

(57) ABSTRACT

An oilfield elevator including a locking mechanism operable by axial movement of the elevator's first body segment relative to its second body segment to control pivotal rotation about a hinge between the body segments; and an actuation lever positioned between the first body segment and the second body segment, the actuation lever including a protrusion thereon and being moveable to drive the protrusion against the first body segment to drive the first body segment axially relative to the second body segment.

20 Claims, 7 Drawing Sheets

OILFIELD ELEVATOR

FIELD

The invention relates to an oilfield pipe elevator.

BACKGROUND

An elevator is a hinged mechanism with two segments that may be closed around tubulars such as drillpipe, casing or other drillstring components to facilitate moving them into and out of the wellbore and about the rig. When the elevator segments are in the closed position, the elevator segments are latched together to form a load-bearing ring, which may be positioned around the component. A shoulder or taper on the component to be lifted is larger in size than the inside diameter of the closed elevator. In the open position, the elevator segments may be rotated about their hinged connection to swing away from the tubular.

A manual elevator requires a person to drive the segments about the hinge to open or close the elevator and may require a person to actuate a latch and possibly a lock between the segments.

SUMMARY

In accordance with a broad aspect of the present invention, there is provided an oilfield elevator comprising: a first body segment including a first end and an outboard end; a second body segment including a first end and an outboard end, the first body segment being pivotally connected through a hinge at its first end to the first end of the second body segment and the first and second body segments being releasably connectable at their outboard ends to form a pipe-receiving opening therebetween; a locking mechanism operable by axial movement of the first body segment relative to the second body segment to control pivotal rotation about the hinge; and an actuation lever positioned between the first body segment and the second body segment, the actuation lever including a protrusion thereon and being moveable to drive the protrusion against the first body segment to drive the first body segment axially relative to the second body segment.

In accordance with a broad aspect of the present invention, there is provided an oilfield elevator comprising: a first body segment including a first end, a barrel at the first end and an outboard end, the barrel including a cam surface; a second body segment including a first end, lugs at the first end and an outboard end, a hinge formed by the pivotal connection of the barrel, lugs and a hinge pin; wherein the first and second body segments are releasably connectable at their outboard ends to form a pipe-receiving opening therebetween; an actuation lever positioned at the hinge between the barrel and lugs, the actuation lever including a cam surface; and a power cylinder connected at one end to the actuation lever and at another end to a connection on the second body segment; wherein the actuation lever and power cylinder move cooperatively in a planar direction to move the first and second body segments axially by interaction between the actuation lever cam surface and the barrel cam surface.

In accordance with a broad aspect of the present invention, there is provided a method for operating a pipe elevator comprising: (a) providing a pipe elevator including: a first body segment with a first end and an outboard end, a second body segment with a first end and an outboard end, the first body segment being pivotally connected through a hinge at its first end to the first end of the second body segment, wherein the first and second body segments are releasably connectable at their outboard ends to form a pipe-receiving opening therebetween, a locking mechanism operable to be locked and unlocked by axial movement of the first body segment relative to the second body segment to control pivotal rotation about the hinge; and (b) moving the first body segment axially relative to the second body segment to release the locking mechanism before any rotational movement of the first body segment and the second body segment is initiated about the hinge.

In accordance with a broad aspect of the present invention, there is provided an oilfield elevator comprising: a first body segment including a first end and an outboard end; a second body segment including a first end and an outboard end, the first body segment being pivotally connected through a hinge at its first end to the first end of the second body segment and the first and second body segments being releasably connectable at their outboard ends to form a pipe-receiving opening therebetween; and a locking mechanism operable by axial movement of the first body segment relative to the second body segment to control pivotal rotation about the hinge.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1A:
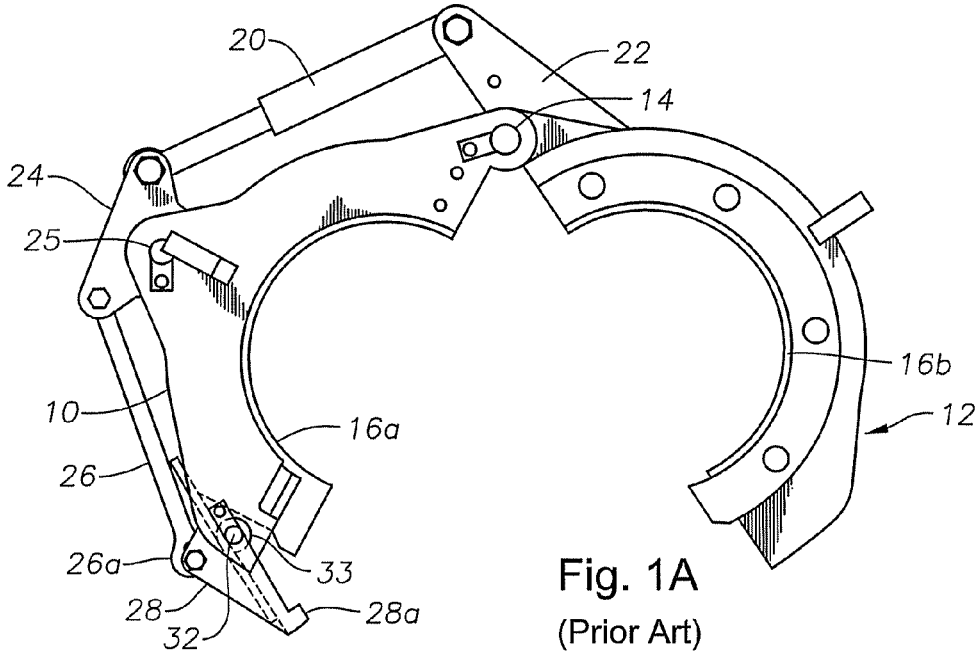
Fig. 1A (Prior Art)
FIG. 1*a* is a top plan view of a prior art automated single joint elevator in an open position.
Figure 1B:
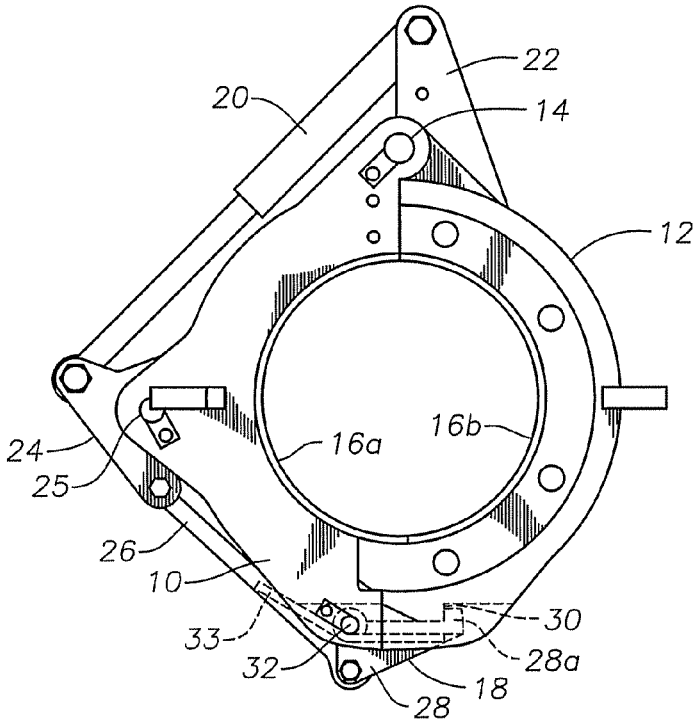
Fig. 1B (Prior Art)
FIG. 1*b* is a top plan view of the prior art automated single joint elevator of FIG. 1*a* in the closed position.

FIGS. 1*a* and 1*b* show a prior art automated elevator. An elevator includes a first segment 10 and a second segment 12 connected by a hinge 14. Each segment has a hinged end and an outboard end. In operation, an elevator is moveable between an open position, shown in FIG. 1*a*, and a closed position, shown in FIG. 1*b*. Each segment includes an inner edge 16*a*, 16*b* formed as at least a portion of a circle such that when the outboard ends are brought together in the closed position, the segments together form a generally circular opening that may be placed about a tubular to be handled thereby.

In the open position, a tubular may be inserted through the opening between the outboard ends of the segments opposite hinge 14 and once the tubular is in position, segments 10, 12 may be closed about the tubular. By selection of the segment size and/or parts forming the inner edges 16*a*, 16*b*, an upset portion of the tubular will catch on the inner edges 16*a*, 16*b* such that the tubular cannot pass out from the elevator once the segments are secured, as by use of a latch 18, about the tubular. Latch 18, in this embodiment, includes catch plate 28, which includes an extension 28*a* that may be engaged behind a stop 30 on second segment 12 to secure the segments together.

An elevator as shown, may be automated to open and close by including a link arrangement and a driver. For example, an automated elevator may include a cylinder 20 pivotally connected between first segment 10 and second segment 12 and set up to drive rotation about hinge 14. In one embodiment, the cylinder may be pivotally connected between a bracket 22 on one of the segments and a bracket 24 on the other of the segments such that extension and retraction of the cylinder drives the segments to rotate about the hinge.

Bracket 24 is also pivotally connected to its segment, in this case elevator segment 10, such that retraction of the cylinder also causes bracket 24 to pivot about its pivotal connection 25 to segment 10. A link rod 26 is pivotally connected to bracket 24 to move therewith. Link rod 26 is connected at its opposite end 26*a* to catch plate 28 of latch 18. Link rod 26 is connected to catch plate 28 and configured to drive the catch plate about a fulcrum 32 to move the extension into and out of engagement with stop 30.

In operation to close the elevator segments (to go from the position of FIG. 1*a* to that of FIG. 1*b*), for example, cylinder 20 may be extended to drive the segments such that their outboard ends come together about hinge 14. This movement of cylinder 20 drives bracket 24 toward link rod 26 and link rod 26 drives catch about its fulcrum 32 to move extension 28*a* behind stop 30. A spring 33 may be positioned about fulcrum 32 to bias catch 28 into a latched position with stop 30.

With reference to FIGS. 2 and 3 an automated elevator has been proposed which provides an alternate mechanism over a prior art elevator as shown in FIG. 1*a*. In the illustrated embodiment, the elevator includes a first segment 110 and a second segment 112 connected by a hinge 114. Each segment includes a hinged end and an outboard end 110*a*, 112*a*. In operation, this elevator is moveable between a closed position, shown in FIGS. 2*a* to 2*c* and an open position, shown in FIG. 2*d*. Hinge 114 includes a hinge pin 123 that defines an axis x about which the segments may rotate to open and close. To define the hinge, portions of the segments may be mounted to rotate on the hinge pin. For example, lugs 134 of one segment may be fixed or pivotally mounted on either end of the hinge pin and a barrel 138 of the other segment may pivotally ride on hinge pin between lugs 134. Each segment includes an inner curved edge 116*a*, 116*b* formed as at least a portion of a circle such that when the outboard ends are brought together in the closed position, the segments form a generally circular pipe-receiving opening therebetween that may be placed about a tubular to be handled thereby.

In the open position, a tubular may be inserted through the opening between the outboard ends of the segments opposite hinge 114. Once the tubular is in position, segments 110, 112 may be closed about the tubular. By selection of the segment sizes and/or parts forming the inner edges 116*a*, 116*b*, an upset portion of the tubular will catch on the inner edges and cannot pass out from the elevator once the segments are secured, as by use of one or more locking mechanisms, about the tubular.

An elevator as shown, may be automated to open and close by an automation system that acts about the hinge to both actuate the locking mechanisms and to rotate the segments. Although the elevator may include a locking mechanism between the outboard ends opposite the hinge, a mechanism acting about the hinge may control the actuation of that locking mechanism. In such an embodiment, therefore the installation of actuators including cylinders, brackets, links, moveable latches or other parts about the opening side of the elevator, opposite the hinge, may be avoided.

In the illustrated embodiment, the automation system includes a driver and an actuation lever including a locking mechanism actuator and a segment drive mechanism to cause rotation of the segments hinge. In the illustrated embodiment the driver includes a cylinder 120 mounted, through a fixed connection or, as shown, a pivotal connection 121, at one end to one of the segments, which in this embodiment is second segment 112. At the opposite end, cylinder 120 is mounted by a pivotal connection to an actuation lever 122. Of course, various drivers could be used such as screw drives, pneumatic or hydraulic cylinders, etc.

The actuation lever is installed to rotate about hinge pin 123 of hinge 114, as shown by arrow B. Hinge in the illustrated embodiment, lever 122 includes a pair of spaced apart bearings 122*a* including apertures through which the hinge pin extends when the lever is mounted to hinge pin 123 and an input extension 122*b* including two plates including apertures 122*c* or other means through which the lever is pivotally connected to cylinder 120.

Actuation lever 122 may be formed to actuate at least one locking mechanism acting between the segments and/or to engage one of the segments to cause rotation of that segment relative to the other segment around the hinge.

One or more locking mechanisms may be provided to secure the segments together when in the closed position. In the illustrated embodiment, the elevator includes two locking mechanisms actuated by axial displacement of the segments relative to each other. However, it is to be understood that one, or more of these or other various locking mechanisms may be used as desired.

Figure 2A:
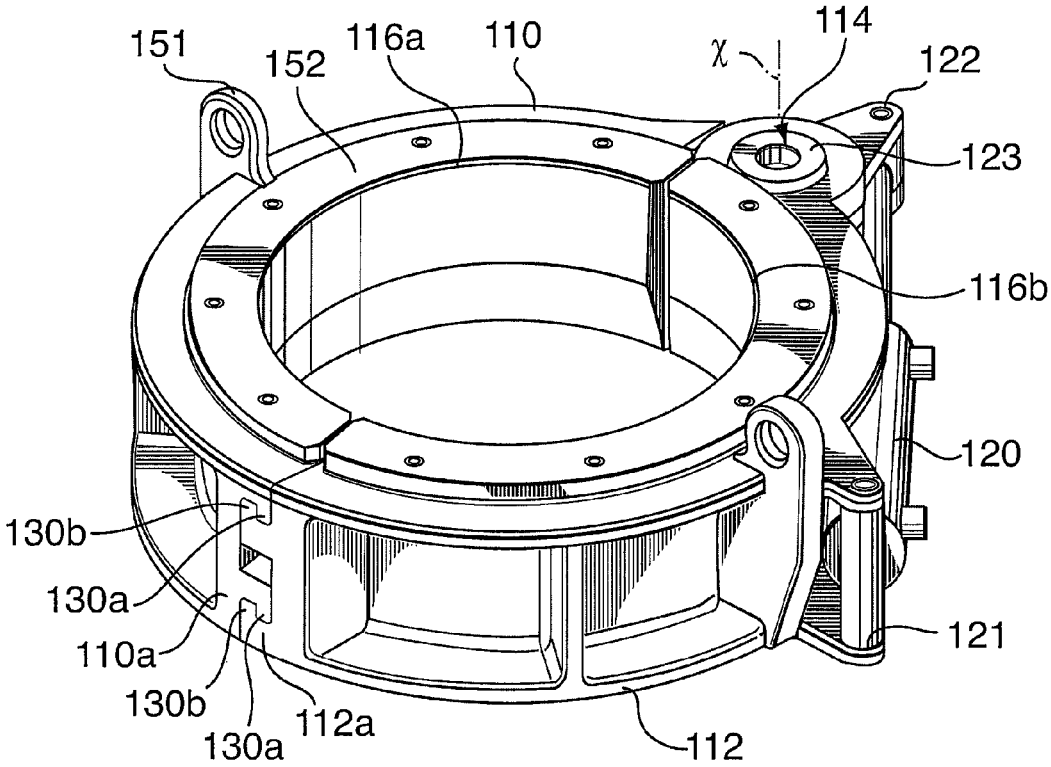
FIG. 2*a* is a top perspective view of one embodiment of a single joint elevator according to the present invention with the segments in the closed position.
Figure 2B:
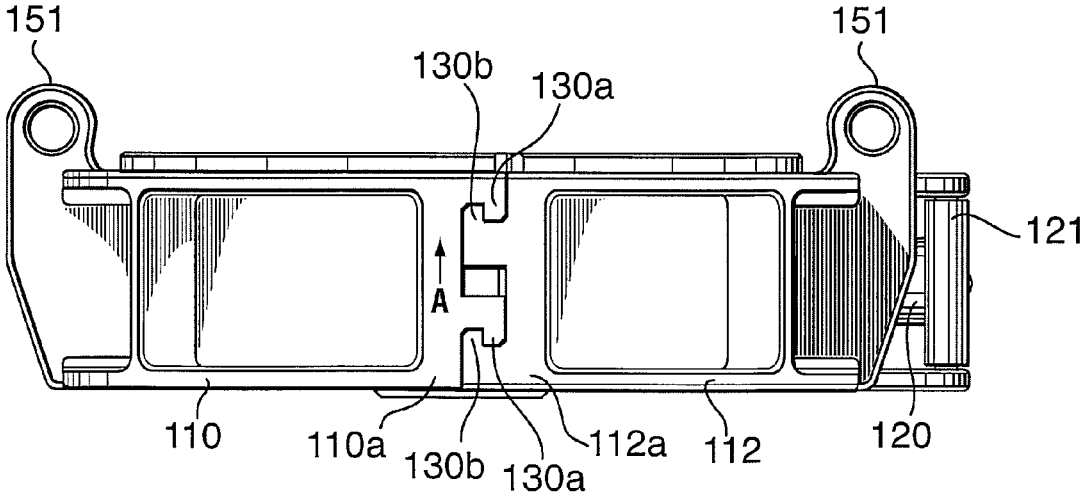
FIG. 2*b* is a front elevation of the elevator of FIG. 2*a* in the closed position.
Figure 2C:
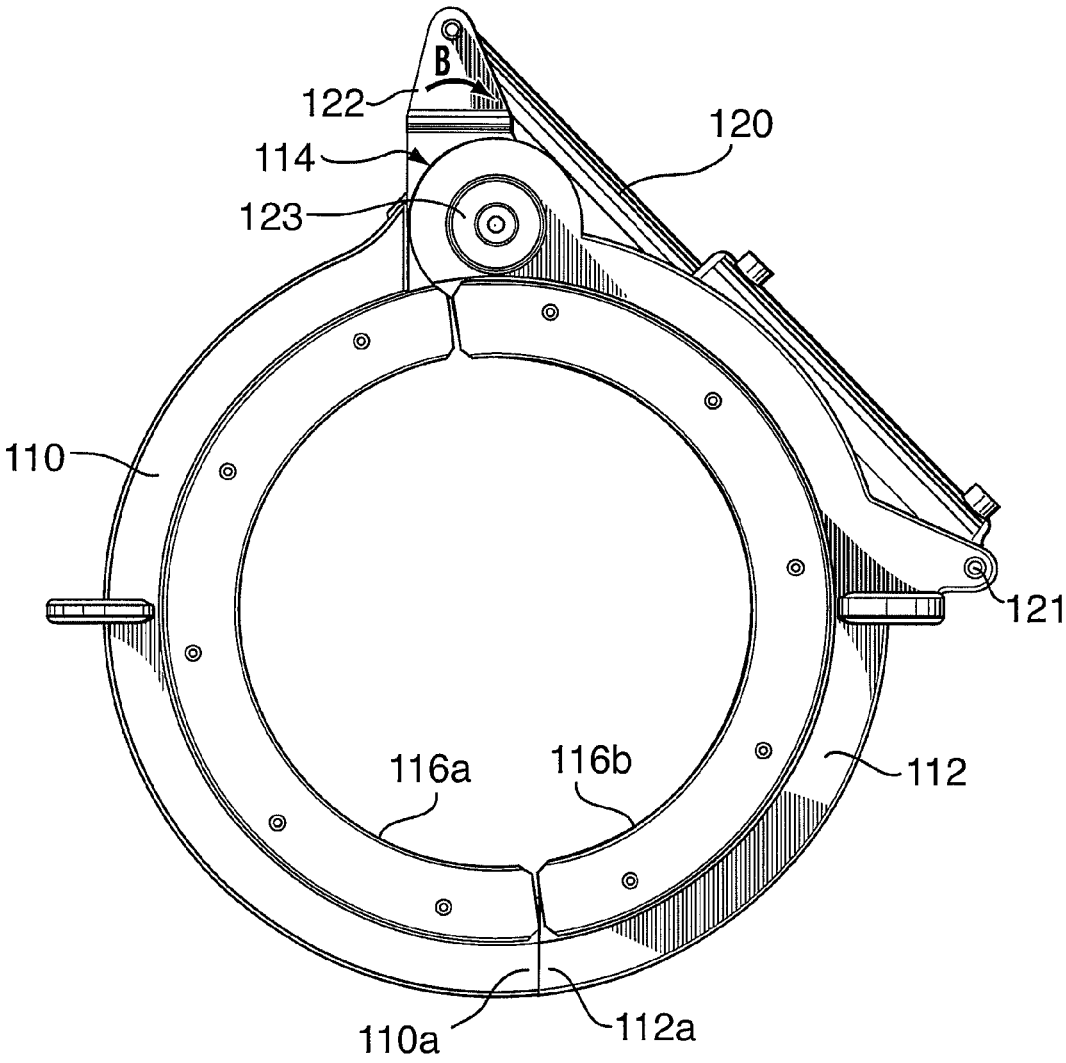
FIG. 2*c* is a top plan view of the elevator of FIG. 2*a* in the closed position.
Figure 2D:
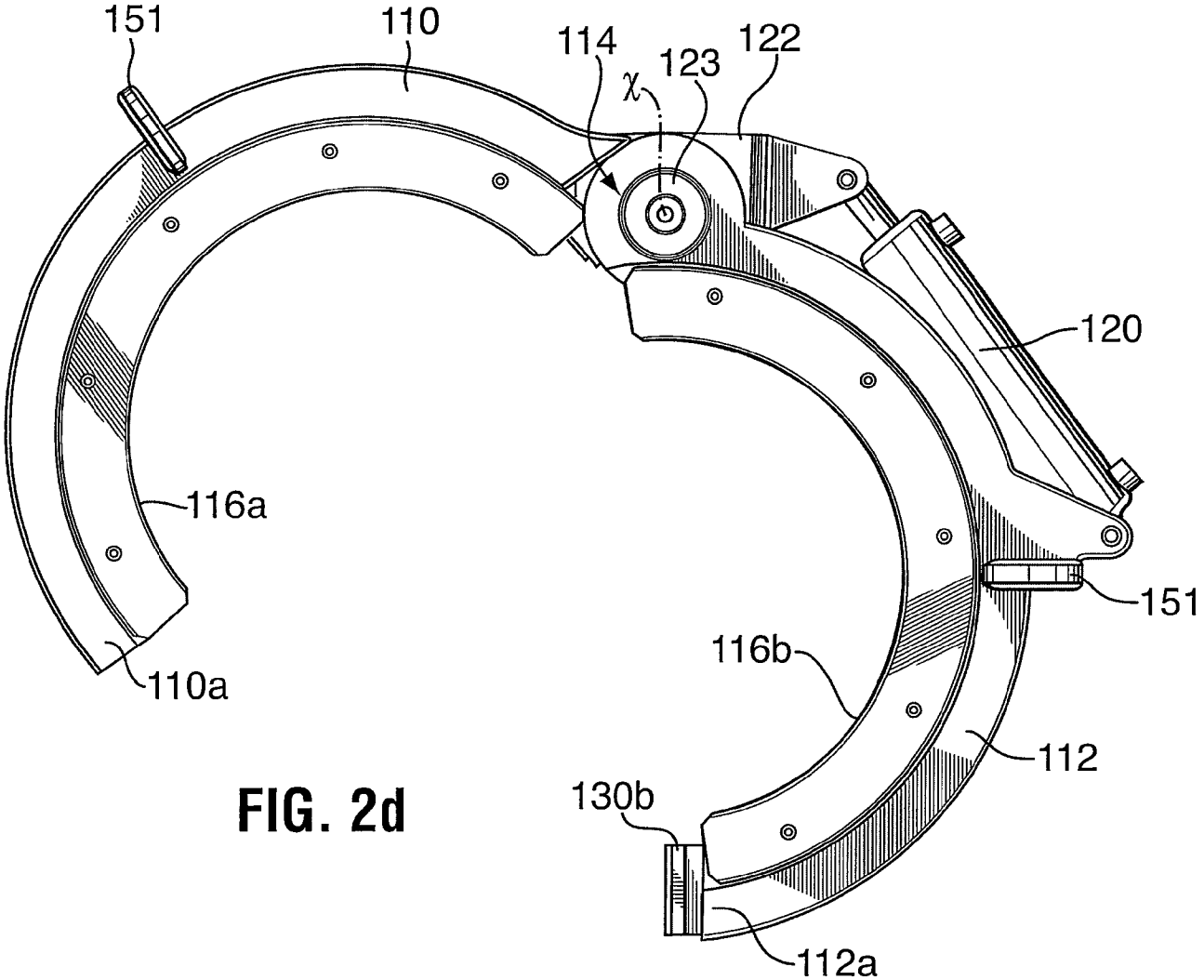
FIG. 2*d* is a top plan view of the elevator of FIG. 2*a* in the open position.
Figure 3A:
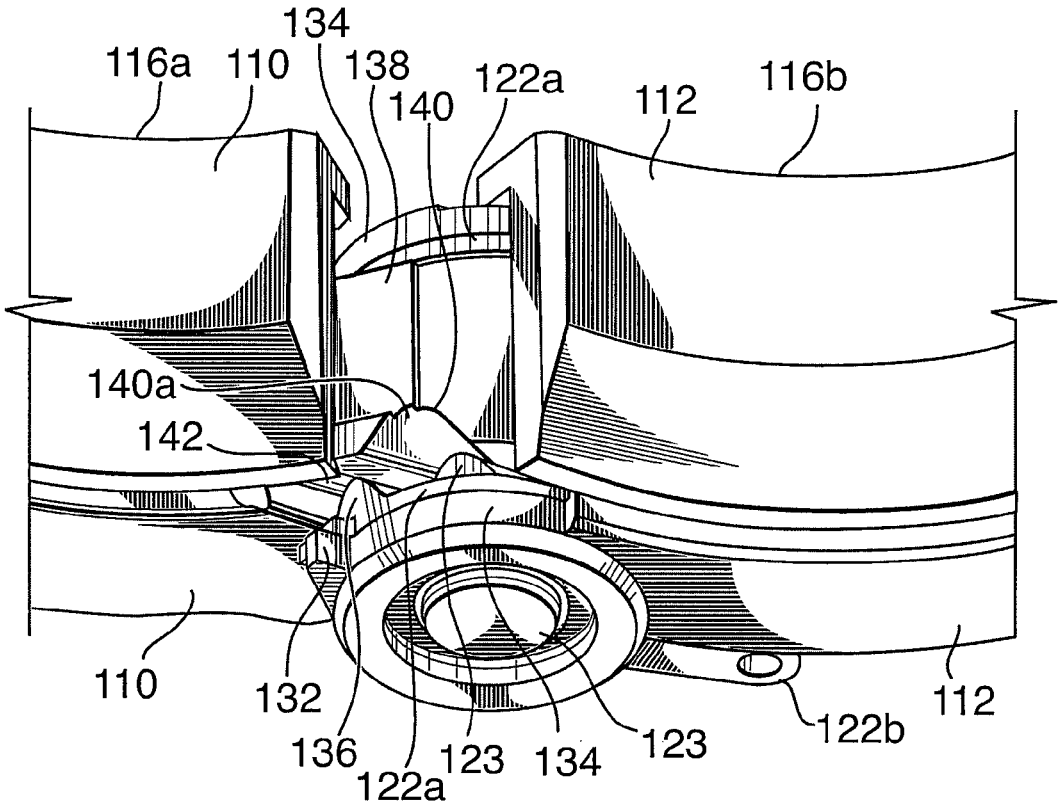
FIG. 3*a* is an enlarged view from the front of the hinge portion of the elevator of FIG. 2*d;*
Figure 3B:
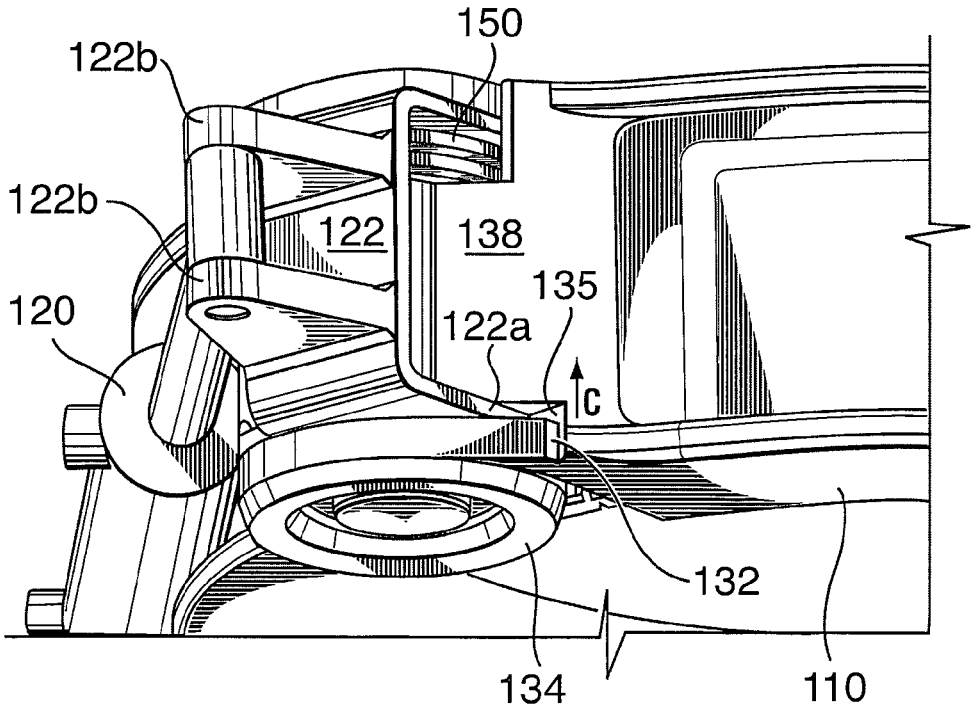
FIG. 3*b* is an enlarged view from the rear of the hinge portion of the elevator of FIG. 2*a;*
Figure 3C:
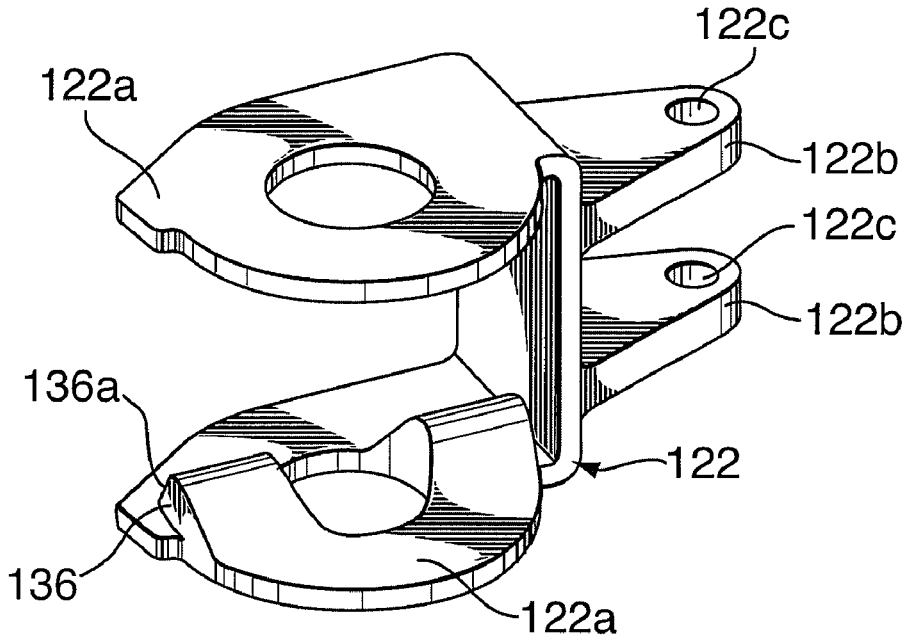
FIG. 3*c* is an enlarged perspective view of an actuation lever useful in one embodiment of an automated elevator.
Figure 3D:
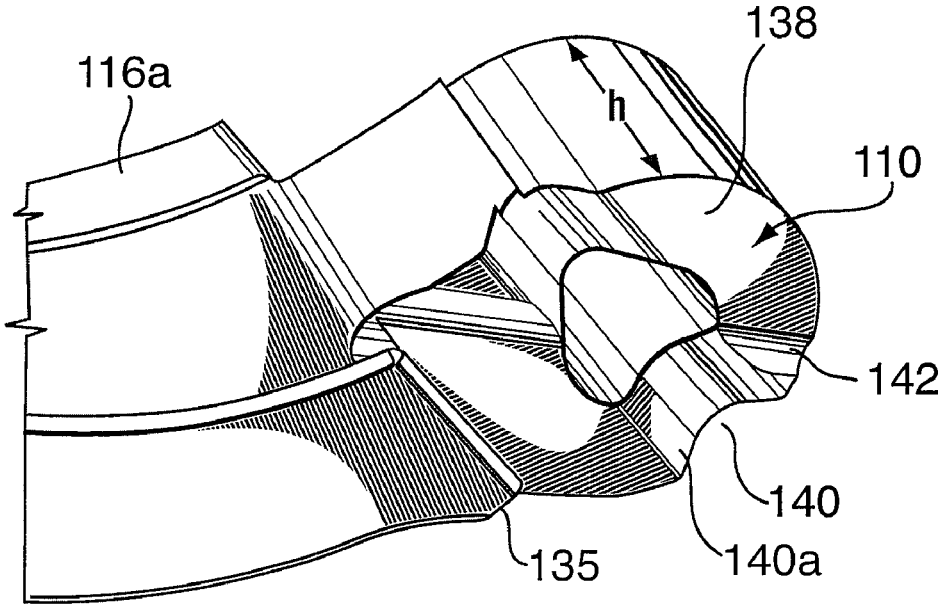
FIG. 3*d* is an enlarged perspective view of a hinge end portion of a segment useful in one embodiment of an automated elevator.
Figure 3E:
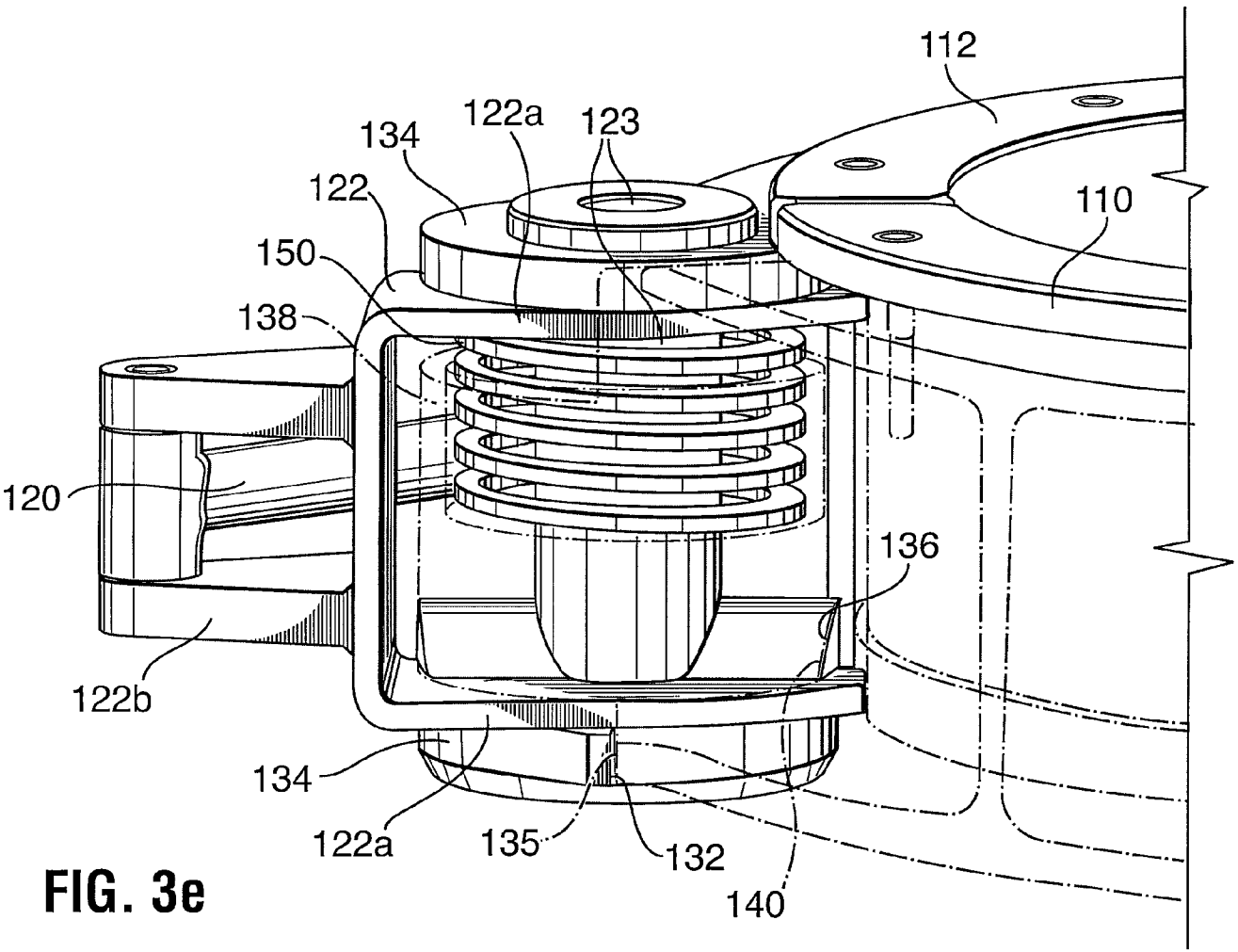
FIG. 3*e* is an enlarged cutaway view from the rear of the hinge portion of the elevator of FIG. 2*a.*

A locking mechanism may be provided between outboard ends 110*a*, 112*a* of the segments. The locking mechanism may include an interlocking feature that operates to prevent rotation of the segments about hinge 114 when the segments are operating in the same plane. However, such an interlocking locking mechanism may be disengaged by axial displacement of one segment relative to the other. In the illustrated embodiment, for example, corresponding hooks 130*a*, 130*b* are provided on facing portions of ends 110*a*, 112*a*. Hooks 130*a*, 130*b* are formed to permit the segments to be rotated relative to each other when one segment 110 is raised (i.e. axially offset) relative to the other segment 112 (FIG. 2*d*), but hooks 130 are formed to interengage when the hooks are axially aligned and the raised segment is set down to assume a position with its upper surface substantially in the same plane as the upper surface of the other segment (FIGS. 2*a* to 2*b*). When the segments are locked together by hooks 130*a*, 130*b*, the segments cannot be rotated about hinge 114. However, if it is desired to open the elevator segments, one segment, for example segment 110, must be lifted along arrow A to move the hooks out of engagement so that the segments can be pulled apart. Although two sets of hooks are shown in the illustrated embodiment, it will be appreciated that one or more pairs of hooks may operate to secure the parts together. However, it is noted that where multiple sets of hooks are used, sufficient space must be provided axially therebetween to permit the corresponding hook pairs to be interposed into axial alignment. To operate a locking mechanism including hooks 130*a*, 130*b*, as shown, an actuator must be provided to raise one segment relative to the other.

Another locking mechanism may alternately or in addition be positioned adjacent hinge 114 to control rotation about the hinge. The locking mechanism may include an abutment 132 that operates to stop rotation of the segments about hinge 114 when the segments are operating in the same plane but which may be avoided by axial displacement of one segment relative to the other. In the illustrated embodiment, for example, abutment 132 is fixed in a position relative to hinge pin 123, in this embodiment on lug 134 extending from the second segment 112. Abutment 132 is positioned to butt against a portion of segment 110, such as shoulder 135 to stop rotation of the first segment about the hinge. However, stopping against abutment 132 may be avoided by raising segment 110 up along hinge pin 123, arrow C, until shoulder 135 of segment 110 is moved clear of the abutment. To operate a locking mechanism including an abutment at hinge 114, as shown, an actuator must be provided to raise one of the segments relative to the other.

In the illustrated embodiment, actuation lever 122 provides a lock mechanism actuator that raises segment 110 relative to segment 112. With reference to FIG. 3, for example, actuation lever 122 is positioned with at least one of its bearings 122*a* acting between the segments 110, 112. In particular, the lower most bearing of the lever rides between lower lug 134 and barrel 138 and includes a protrusion 136 on a surface positioned in contact with and below hinge barrel 138 of segment 110. Protrusion 136 acts with and is formed to fit into a corresponding detent 140 in the lower surface of barrel 138 and can be moved into or out of the detent to raise and lower segment 110. As such, the protrusion can cause a camming action where it can be driven to wedge between the segments and force them apart (i.e lift the first segment away against gravity away from the second segment). In particular, protrusion 136 is formed on the lower bearing 122*a* of the actuation lever and detent 140 is formed on the barrel in relative positions so that when the actuation lever and segments 110 and 112 are in the elevator closed position, the protrusion is positioned in detent 140 permitting barrel 138 to be in a lowermost position on hinge pin 123. When the elevator is in the closed position and actuation lever 122 initially rotates about hinge pin 123, the locking mechanisms which are engaged prevent rotation of segment 110 and so rotation of the lever causes protrusion 136 on lever 122 to move out of detent 140 and protrusion 136 drives barrel 138 to slide upwardly along hinge pin 123. This raises segment 110 relative to segment 112. To facilitate the movement of protrusion 136 out of detent 140*a*, the side edges 136*a*, 140*a* of one or both of the protrusion and the detent can be ramped.

It will be appreciated that once the segments are axially displaced to disengage the one or more locking mechanisms, the segments can be pivoted open about hinge. This opening movement could be achieved in various ways for example manually, by drivers, etc. However, in the illustrated embodiment, actuation lever 122 further provides an automation system for driving opening and closing of the segments, as desired, by driving cylinder 120. For example, in the illustrated embodiment lever 122 is formed to engage and drive rotation of the segment opposite to the one on which the driver, cylinder 120, is mounted. As illustrated, for example, a second detent 142 can be provided on barrel 138 into which protrusion 136 may engage. When engaged in second detent 142, the protrusion may engage and drive segment 110 to rotate with the actuation lever as it is driven to rotate by the cylinder. Thus, engagement between protrusion 136 and second detent 142 may act to permit the engaged segment to be driven to open or close, as actuation lever 122 is moved.

It will also be appreciated that the protrusion and one or more detents act as cam surfaces and the positions of the protrusion and the detents may be reversed so that the detents are positioned on the actuation lever and the protrusion is positioned on the barrel of the segment to be driven. Also, the protrusions and the detents may be formed in various ways such as those shown or by smaller forms, or with more angular definition, etc.

Hinge 114 may be formed to permit the axial movement of barrel 138 along hinge pin 123. For example, the height h of barrel 138 may be less than the distance between the fixed structures about hinge pin 123 on either side of the barrel. This allows some axial movement of the barrel along pin 123. If desired, a biasing member, such as a spring 150 or other compressible member may be positioned to bias barrel 138, and therefore the segment to which barrel 138 is attached, down against the actuation lever and into a locked position. When using a spring 150, any movement to raise the barrel along the hinge pin must act against and overcome the force in the spring.

Extension and retraction of the cylinder drives actuation lever 122 to rotate about hinge pin 123 to drive operation of the segments. For example, when the cylinder retracts, actuation lever 122 is rotated along arrow B and first raises segment 110 axially relative to the other segment such that the locking mechanisms become disengaged. Then, by engagement of segment 110, lever 122 drives the segments to rotate open about the hinge. When it is desired to close the elevator, the cylinder may be driven to extend and push the actuation lever to rotate about hinge pin 123 with protrusion 136 located in detent 142, which will move the outboard end of the first segment toward the outboard end of the second segment to close the elevator. Once segment 110 hits against end 112*a* of the second segment, rotation of the first segment is stopped and protrusion 136 moves from detent 142 to detent 140. This allows barrel 138 and the segment to drop down into a locked configuration using hooks 130*a*, 130*b* and abutment 132

If desired, an automated elevator may also include a safety lock function to prevent inadvertent opening of its segments when the elevator is in use. In the illustrated embodiment, the power of cylinder 120 may be selected such that it is sufficient to lift one segment up relative to the other if the elevators are empty. However, the cylinder may be selected to provide insufficient drive to axially offset the segments if the weight of a tubular is bearing on the segment to be raised, (i.e. on edges 116*a*). The cylinder may be selected to simply stop moving when resistance is encountered. Alternately, the hydraulic system driving the cylinder may be provided with sensors and a control system selected to shut down the system when a pressure over a selected level is sensed in the cylinder.

An elevator as described herein can be automated such that it can be operated to open and close without manual handling. For example, with a power source and control for the driver, the elevator can be operated remotely by actuation and control of the power source. In an embodiment including a hydraulic cylinder, a hydraulic system including lines, fluid supply and valves and control system can be used to operate the elevator substantially without the need for direct contact by a rig hand.

The elevator can include eyes 151 through which it is supported and moved about in a rig. For example, eyes 151 can be formed in various ways to accept installation of cables, link arms etc. hanging in the rig. The elevator may also accept removable and replaceable inserts 152 for permitting selection of the inner diameter of the opening between edges 116*a* and 116*b*.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope as defined in the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. An oilfield elevator comprising:

a first body segment including a first end and an outboard end;

a second body segment including a first end and an outboard end, the first body segment being pivotally connected through a hinge at its first end to the first end of the second body segment and the first and second body segments being releasably connectable at their outboard ends to form a pipe-receiving opening therebetween, a locking mechanism operable by axial movement of the first body segment relative to the second body segment to control pivotal rotation about the hinge;

an actuation lever positioned between the first body segment and the second body segment, the actuation lever including a protrusion thereon and being moveable to drive the protrusion against the first body segment to drive the first body segment axially relative to the second body segment; and wherein the locking mechanism includes abutting shoulders on the first and second body segments at the hinge and the abutting shoulders can be moved out of abutment to permit the first segment to rotate about the hinge.

2. The oilfield elevator of claim 1 wherein the locking mechanism further comprises a set of interlocking hooks at the outboard ends of the first and second body segments, such interlocking hooks being engaged and disengaged by axial movement of the first body segment relative to the second body segment.

3. The oilfield elevator of claim 1 further comprising a biasing member to resist axial movement to unlock the first and second body segments.

4. The oilfield elevator of claim 1 further comprising a driver to drive movement of the actuation lever.

5. The oilfield elevator of claim 4 wherein the driver includes a hydraulic cylinder.

6. The oilfield elevator of claim 4 wherein the driver includes a pneumatic cylinder.

7. The oilfield elevator of claim 4 wherein the driver is selected to have insufficient power to drive the actuation lever when a pipe is supported in the pipe-receiving opening.

8. An oilfield elevator comprising:

a first body segment including a first end, a barrel at the first end and an outboard end, the barrel including a cam surface;

a second body segment including a first end, lugs at the first end and an outboard end, a hinge formed by the pivotal connection of the barrel, lugs and a hinge pin; wherein the first and second body segments are releasably connectable at their outboard ends to form a pipe-receiving opening therebetween;

an actuation lever positioned at the hinge between the barrel and lugs, the actuation lever including a cam surface; and a power cylinder connected at one end to the actuation lever and at another end to a connection on the second body segment;

wherein the actuation lever and power cylinder move cooperatively in a planar direction to move the first and second body segments axially by interaction between the actuation lever cam surface and the barrel cam surface.

9. The oilfield elevator of claim 8 wherein the actuation lever cam surface is a protrusion and the barrel cam surface is a detent.

10. The oilfield elevator of claim 8 further comprising a biasing member to bias the first body segment into axially alignment with the second body segment.

11. The oilfield elevator of claim 8 wherein the power cylinder is selected to have insufficient power to drive the actuation lever when a pipe is supported in the pipe-receiving opening.

12. A method for operating a pipe elevator comprising:

(a) providing a pipe elevator including:

a first body segment with a first end and an outboard end, a second body segment with a first end and an outboard end, the first body segment being pivotally connected through a hinge at its first end to the first end of the second body segment, wherein the first and second body segments are releasably connectable at their outboard ends to form a pipe-receiving opening therebetween, a locking mechanism operable to be locked and unlocked by axial movement of the first body segment relative to the second body segment to control pivotal rotation about the hinge, the locking mechanism including abutting shoulders on the first ends of first and second body segments at the hinge;

an actuation lever positioned between the first ends of the first body segment and the second body segment, the actuation lever including a protrusion thereon; and (b) rotating the actuation lever relative to the first and second body segments, thereby driving the protrusion against the first body segment and causing the first body segment to move axially relative to the second body segment to release the locking mechanism by moving the abutting shoulders out of abutment before any rotational movement of the first body segment and the second body segment is initiated about the hinge.

13. The method for operating a pipe elevator of claim 12 wherein rotating the actuation lever moves the first body segment upwardly relative to the second body segment.

14. The method for operating a pipe elevator of claim 12 further comprising, (c) continuing to rotate the actuation lever, thereby driving the first body segment to rotate about the hinge.

15. The method for operating a pipe elevator of claim 12 wherein rotating the actuation lever cannot proceed with a pipe supported in the pipe-receiving opening of the elevator.

16. The method for operating a pipe elevator of claim 12 further comprising, (c) continuing to rotate the actuation lever, causing the protrusion on the actuation lever to engage a driving detent within the first body segment to drive the first body segment to rotate about the hinge.

17. An oilfield elevator comprising:

a first body segment including a first end and an outboard end;

a second body segment including a first end and an outboard end, the first body segment being pivotally connected through a hinge at its first end to the first end of the second body segment and the first and second body segments being releasably connectable at their outboard ends to form a pipe-receiving opening therebetween;

the first body segment being axially movable relative to second body segment from a locked position to a rotatable position;

shoulders on the first ends of the first body segment and the second body segment that abut each other while in the locked position to prevent rotation of the first body segment relative to the second body segment, and which move out of abutment when the first body segment is moved to the rotatable position;

an actuation lever mounted between the first ends of the first and second body segments, the actuation lever being rotatable relative to the first and second body segments from a locked position to a driving position;

a protrusion on the actuation lever that moves the first body segment axially from the locked position to the rotatable position when the actuation lever is rotated relative to the first and second body segments from the locked position to the driving position; and a driving detent formed on the first body segment that is engaged by the protrusion while the actuation lever is in the driving position, such that continued rotation of the actuation lever rotates the first body segment to an open position.

18. The oilfield elevator of claim 17, wherein the locking mechanism further comprises a set of interlocking hooks at the outboard ends of the first and second body segments, such interlocking hooks being engaged and disengaged by the axial movement of the first body segment relative to the second body segment.

19. The oilfield elevator of claim 17, further comprising a spring mounted between the first ends of the first and second body segments, the spring biasing the first body segment toward the locked position.

20. The oilfield elevator of claim 17, further comprising a locking detent on the first end of the first body segment, the protrusion on the actuation lever being positioned within the locking detent while in the locked position.

* * * * *